US011072974B2

(12) United States Patent
Wong

(10) Patent No.: US 11,072,974 B2
(45) Date of Patent: Jul. 27, 2021

(54) CORDLESS ROLLER SHUTTER STRUCTURE

(71) Applicant: Ming Lu Wong, Kaohsiung (TW)

(72) Inventor: Ming Lu Wong, Kaohsiung (TW)

( * ) Notice: Subject to any disclaimer, the term of this patent is extended or adjusted under 35 U.S.C. 154(b) by 281 days.

(21) Appl. No.: 16/250,509

(22) Filed: Jan. 17, 2019

(65) Prior Publication Data

US 2019/0323285 A1 Oct. 24, 2019

(30) Foreign Application Priority Data

Apr. 23, 2018 (TW) ..... 107205281

(51) Int. Cl.

| | |
|---|---|
| ***E06B 9/174*** | (2006.01) |
| ***E06B 9/72*** | (2006.01) |
| ***E06B 9/74*** | (2006.01) |
| *E06B 9/68* | (2006.01) |

(52) U.S. Cl.

CPC ..... *E06B 9/174* (2013.01); *E06B 9/72* (2013.01); *E06B 9/74* (2013.01); *E06B 2009/6809* (2013.01)

(58) Field of Classification Search

CPC ... E06B 1/174; E06B 9/50; E06B 9/42; E06B 9/72; E06B 9/74; E06B 2009/6809

See application file for complete search history.

(56) References Cited

U.S. PATENT DOCUMENTS

| | | | | |
|---|---|---|---|---|
| 6,327,744 | B1 * | 12/2001 | Dorma | E05D 13/1261 16/197 |
| 2005/0035238 | A1 * | 2/2005 | Fun | E06B 9/72 242/381 |
| 2010/0122780 | A1 * | 5/2010 | Cheng | E06B 9/60 160/305 |
| 2012/0241111 | A1 * | 9/2012 | Wolek | E06B 9/60 160/299 |
| 2014/0000819 | A1 * | 1/2014 | Mullet | E06B 9/60 160/311 |
| 2016/0130871 | A1 * | 5/2016 | Pham | E06B 9/42 160/323.1 |
| 2016/0319598 | A1 * | 11/2016 | Waehrisch | F16D 49/16 |
| 2017/0159359 | A1 * | 6/2017 | Vries | E06B 9/42 |
| 2018/0179814 | A1 * | 6/2018 | Kwak | E06B 9/50 |
| 2018/0216404 | A1 * | 8/2018 | Fisher | E06B 9/62 |
| 2018/0252034 | A1 * | 9/2018 | Lin | B60J 1/2063 |
| 2018/0313145 | A1 * | 11/2018 | De Frene | E04F 10/0655 |
| 2019/0323285 | A1 * | 10/2019 | Wong | E06B 9/90 |

* cited by examiner

*Primary Examiner* — Beth A Stephan
(74) *Attorney, Agent, or Firm* — Guice Patents PLLC

(57) ABSTRACT

A cordless roller shutter structure includes a roller shutter fixing seat, a sleeve controller, a tension adjuster and a shutter sheet locating unit. The sleeve controller is fitted in a sleeve and securely disposed on the roller shutter fixing seat. The shutter sheet is controlled to suspend downward or roll upward directly by means of pulling and releasing the lower weight of the shutter sheet without using the bead chain. A bearing is received in each of two collars so that the sleeve can more easily drive the shutter sheet to save strength. In addition, by means of the adjustment disc of the tension adjuster and the shutter sheet locating unit, the ascending/descending speed of the shutter sheet can be adjusted and the sunshade position of the shutter sheet can be locked. Accordingly, the utility and effect of the cordless roller shutter are enhanced.

1 Claim, 14 Drawing Sheets

CORDLESS ROLLER SHUTTER STRUCTURE

BACKGROUND OF THE INVENTION

1. Field of the Invention

The present invention relates generally to a cordless roller shutter structure, and more particularly to a roller shutter mechanism in which the shutter sheet can be directly pulled to conveniently control the shutter sheet to suspend the shutter sheet or upward drive and roll the shutter sheet to a locking position. The roller shutter can be more easily operated and used with the strength saved. In addition, the roller shutter can be more safely used.

2. Description of the Related Art

In a conventional roller shutter structure, the shutter sheet is rolled around a rotary shaft. A controller is disposed on the rotary shaft and a bead chain is wound on the controller. By means of pulling the bead chain, through the controller, the rotary shaft is driven to clockwise rotate or counterclockwise rotate to control the shutter sheet to ascend or descend.

The bead chain is a loop body so that it often takes place that a child plays the bead chain and tangles and winds the bead chain around his neck. In this case, the child may be suffocated to cause danger. Therefore, on the market, the use of the bead chain has been gradually restricted due to security problem.

In order to improve the security problem, some manufacturers have developed a cordless roller shutter structure. The cordless roller shutter structure mainly includes a sleeve for rolling the roller shutter sheet. The sleeve is inserted with an elastic member via an engagement member. The elastic member can collect or release the roller shutter sheet to control the roller shutter sheet to suspend or roll up. The tension of the elastic member will affect the pull application force of the roller shutter sheet so that an operator often feels quite strength-consuming in operation. As a result, it is inconvenient to use such roller shutter structure.

Moreover, in the conventional cordless roller shutter structure, the elastic force of the elastic member serves as the power for rolling the roller shutter sheet. Therefore, it often takes place that the roller shutter sheet is abruptly rolled up. This causes danger in use. Also, the accessories of the cordless roller shutter structure will collide with each other to cause damage.

In addition, the conventional cordless roller shutter lacks the roller shutter sheet locating function. The conventional cordless roller shutter is rolled up by means of the elastic force of the elastic member so that once released, the roller shutter sheet will be rolled up to the uppermost point and cannot be stopped and positioned in a desired position to shade the sunlight as necessary. This is also a shortcoming of the conventional cordless roller shutter.

It is therefore tried by the applicant to provide a cordless roller shutter structure, in which the shutter sheet can be controlled to ascend or descend without using the bead chain so as to eliminate the shortcomings of the conventional cordless roller shutter and enhance the utility of the cordless roller shutter.

SUMMARY OF THE INVENTION

It is therefore a primary object of the present invention to provide a cordless roller shutter structure, in which the shutter sheet can be pulled with less strength. In addition, the shutter sheet can be conveniently controlled to suspend downward or roll upward to a locked position. Moreover, the tension of the spring can be adjusted to roll the shutter sheet tenderly. Accordingly, the cordless roller shutter structure can be more easily and conveniently operated and more safely used.

To achieve the above and other objects, the cordless roller shutter structure of the present invention includes a roller shutter fixing seat having a fixing support frame, two fixing brackets being disposed on two sides of the fixing support frame, a tension adjuster being securely disposed on an inner end face of the fixing bracket on one side and connected with a sleeve controller;

a sleeve controller fitted in a sleeve, the sleeve controller including a plug section fitted with a bearing and a rotor formed with shift recesses and a fitting section, the rotor being connected with the plug section, a threaded section being disposed at one end of the fitting section, the threaded section being fitted with a rotary rod and a control spring fitted on the rotary rod, an engagement member being movably fitted with one end of the control spring, the engagement member being engaged and connected with an inner circumference of the sleeve and located therein, a cushion unit being disposed at one end of the rotary rod, the cushion unit being engaged and connected with the inner circumference of the sleeve and located therein;

a tension adjuster including an adjustment disc and a shaft seat, a connection section protruding from a front end of the shaft seat, the connection section serving to assemble and connect with the plug section of the sleeve controller and drive the fitting section to adjust the tension of the control spring of the sleeve controller; and another shaft seat being securely disposed on inner side of the fixing bracket on the other side, an assembling section protruding from a front end of the other shaft seat for assembling and connecting with a shutter sheet locating unit, the shutter sheet locating unit being disposed at a corresponding end of the sleeve of the sleeve controller, the shutter sheet locating unit including an adjustment threaded rod, an engagement member screwed on the adjustment threaded rod and a locking member, the locking member including a movable plate and a fixed plate, the movable plate being screwed on the adjustment threaded rod, a cushioning spring being fitted on a rear end of the fixed plate, the cushioning spring being fitted around the adjustment threaded rod and connected with a connection seat disposed at a rear end of the adjustment threaded rod and fitted through a sleeve collar to assemble and connect with the assembling section, a rear end of the assembling section being fitted with another adjustment disc for adjusting the position of the locking member so as to control and locate the shutter sheet, a bearing being fitted with each of the plug section of the sleeve controller and the assembling section of the shutter sheet locating unit and received in the sleeve collar so as to provide lubrication effect for the rotation of the sleeve, whereby the sleeve can be rotated with less strength.

According to the above cordless roller shutter structure, the shutter sheet can be pulled with less strength. In addition, the shutter sheet can be conveniently controlled to suspend downward or roll upward to a locked position. Moreover, the tension of the spring can be adjusted to roll the shutter sheet tenderly. Accordingly, the cordless roller shutter structure can be more easily and conveniently operated and more safely used.

The present invention can be best understood through the following description and accompanying drawings, wherein:

DETAILED DESCRIPTION OF THE PREFERRED EMBODIMENTS

Figure 1:
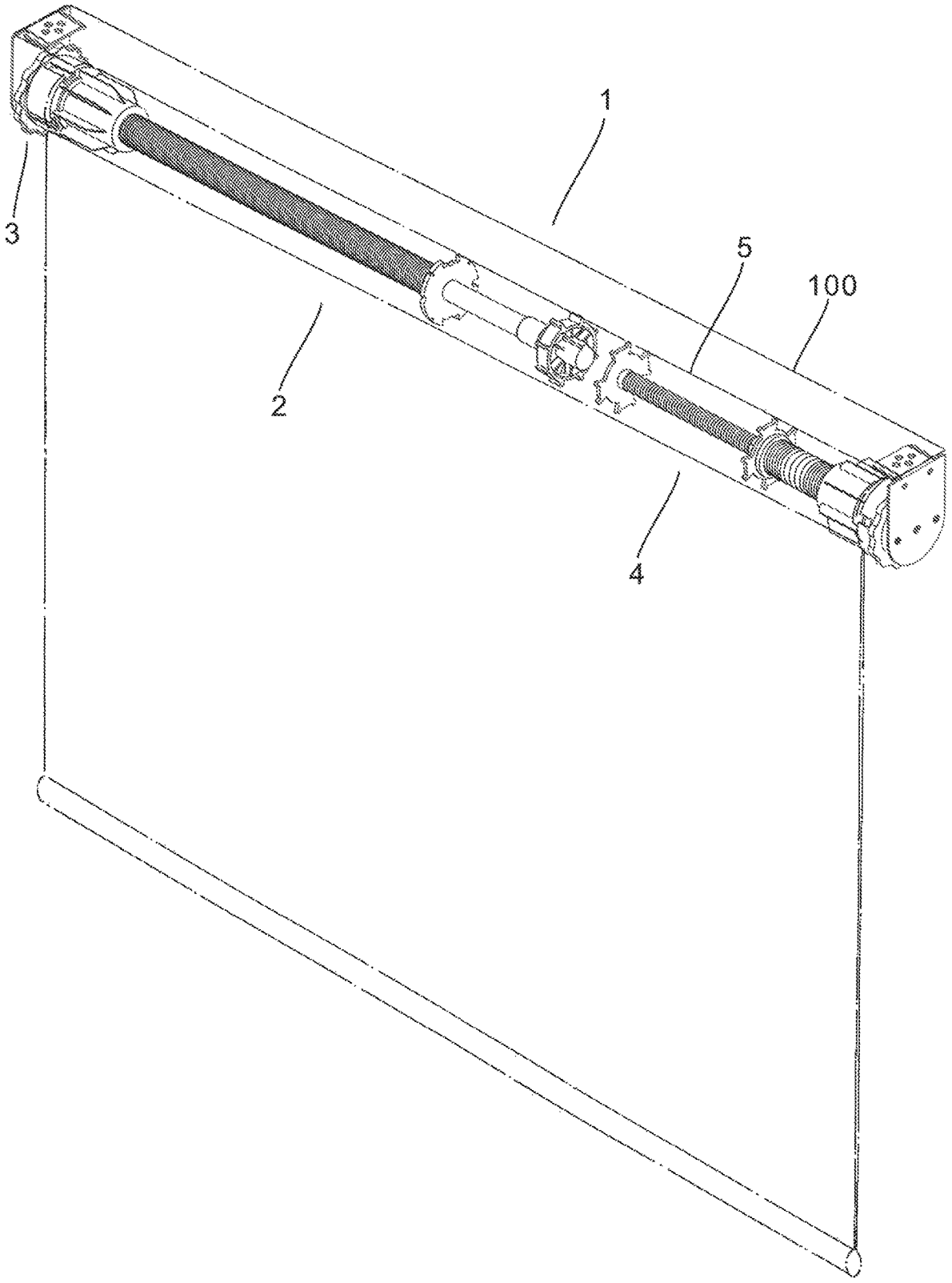
FIG. 1 is a perspective assembled view of the present invention.
Figure 2:
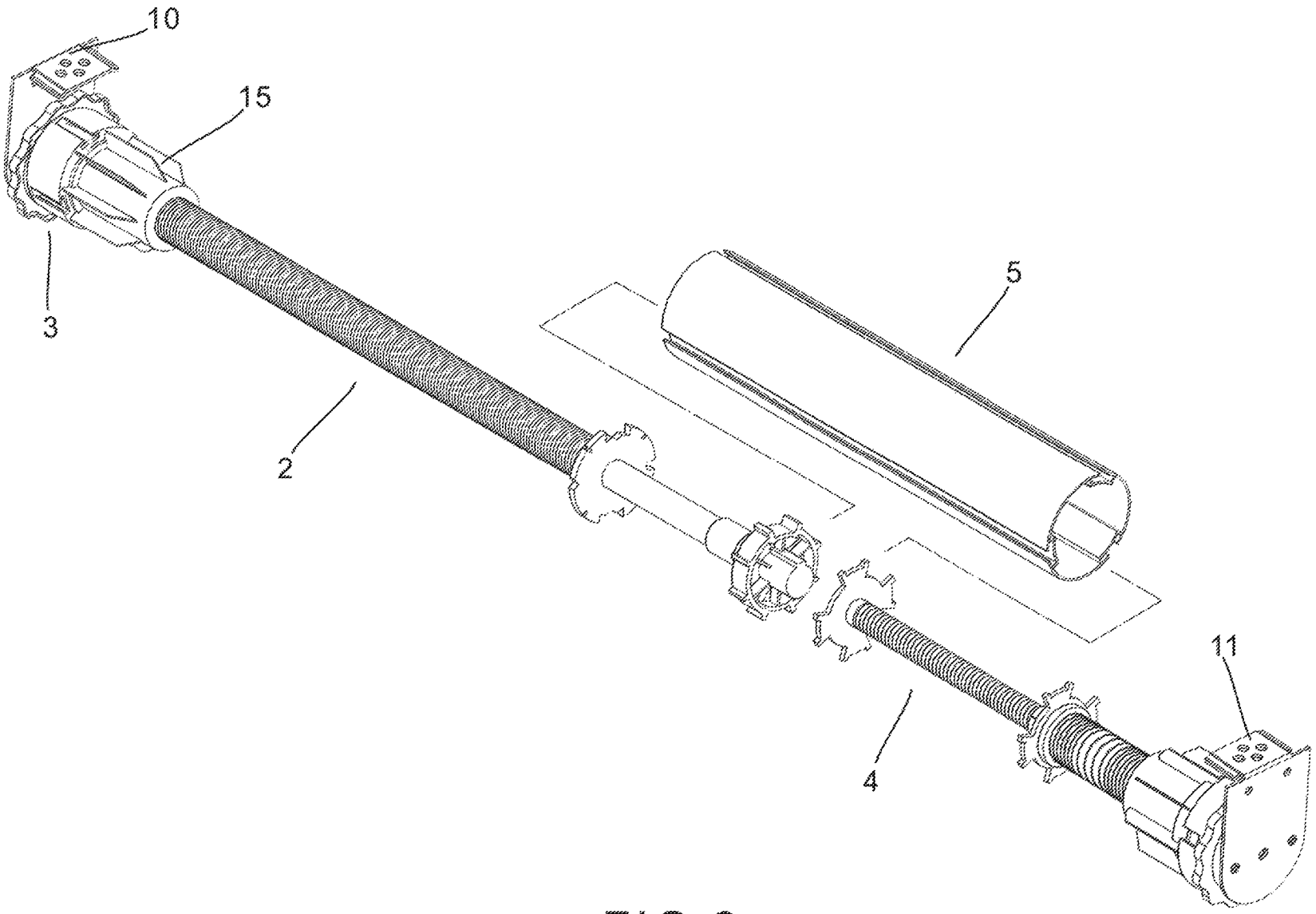
FIG. 2 is a perspective exploded view of the present invention.

Please refer to FIGS. 1 and 2. The cordless roller shutter structure of the present invention includes a roller shutter fixing seat 1, a sleeve controller 2, a tension adjuster 3 and a shutter sheet locating unit 4.

The roller shutter fixing seat 1 has a fixing support frame 100. Two fixing brackets 10, 11 are respectively disposed at two ends of the fixing support frame 100. A shaft seat 12 is securely disposed on an inner end face of the fixing bracket 10. A connection section 13 protrudes from the front end of the shaft seat 12 for connecting with an adjustment disc 14. The adjustment disc 14 serves to drive and rotate the shaft seat 12. A sleeve collar 15 is fitted around the shaft seats 12 of the fixing bracket 10. The sleeve controller 2 is connected with the connection section 13 of the front end of the shaft seat 12 and together received in the sleeve collar 15 (as shown in FIG. 3) and connected on one side of the sleeve 5 via the sleeve collar 15.

Figure 3:
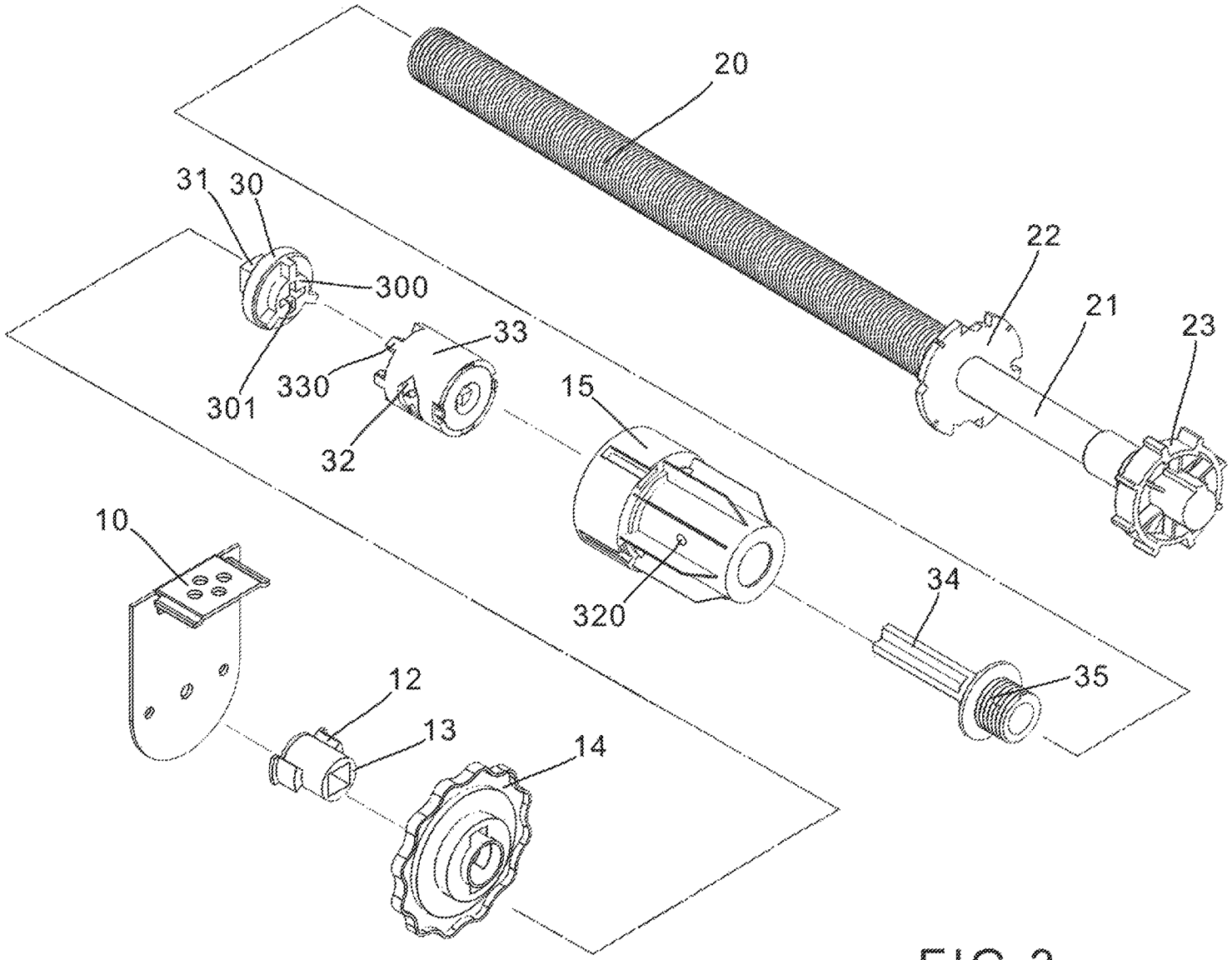
FIG. 3 is a partially exploded view showing the structure of the present invention.
Figure 4:
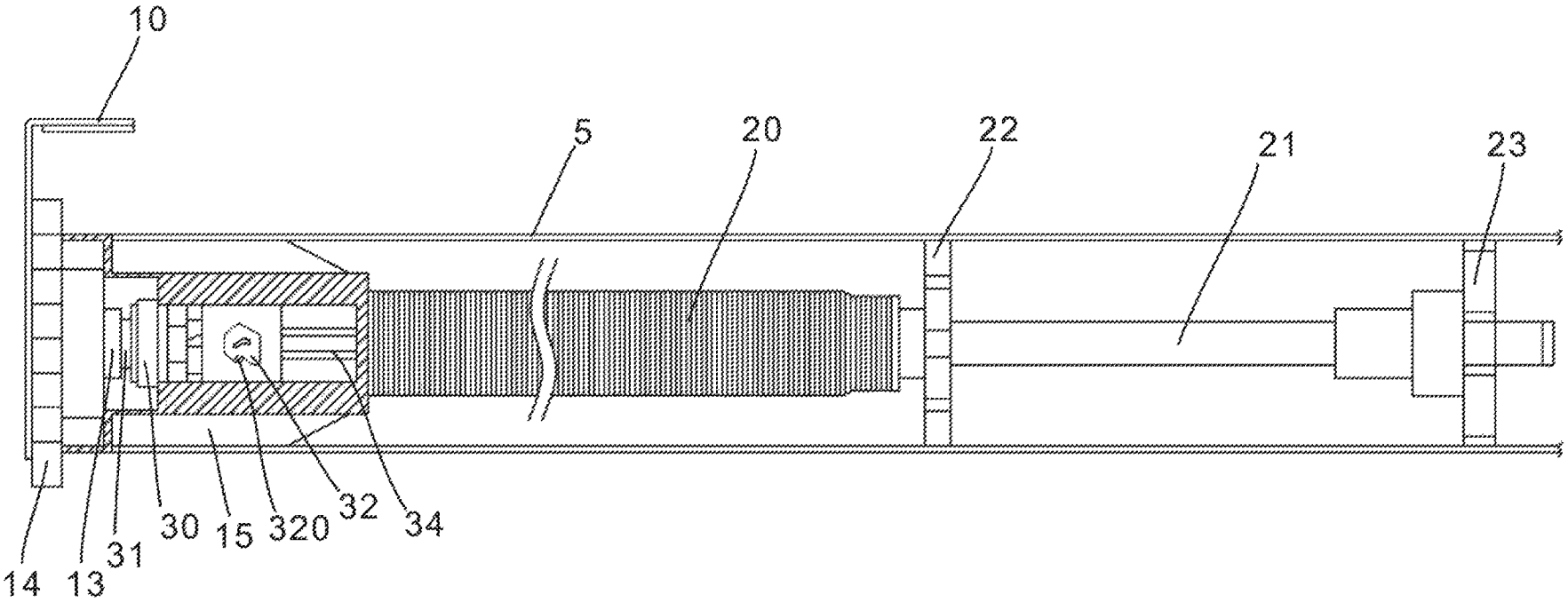
FIG. 4 is a partially sectional view showing the structure of the present invention.

Referring to FIG. 3, the sleeve controller 2 includes a plug section 31 fitted with a bearing 30 and a rotor 33 formed with shift recess 32 and a fitting section 34. The plug section 31 is drivingly assembled and connected with the connection section 13 of the shaft seat 12 of the fixing bracket 10. A linking section 300 is disposed on one side of the plug section 31. A cross-shaped fitting hole 301 is formed at the center of the linking section 300. The linking section 300 is connected with the driving section 330 of the rotor 33 and together received in the sleeve collar 15. A shift pin 320 is disposed in the sleeve collar 15 corresponding to the shift recess 32 of the rotor 33. When the sleeve collar 15 is rotated, the shift pin 320 in the sleeve collar 15 is slid within the shift recess 32 to control and displace the driving section 330 so as to control the location and rolling of the shutter sheet. A cross-shaped stem on one side of the fitting section 34 is passed through the sleeve collar 15 and the rotor 33 to drivingly connect in the cross-shaped fitting hole 301 of the plug section. A threaded section 35 is disposed on the other side of the fitting section 34. A rotary rod 21 and a control spring 20 are securely inserted with the threaded section 35. The adjustment disc 14 serves to drive the shaft seat 12 to rotate so as to drive the plug section 31 to rotate, whereby the fitting section 34 is rotated with the plug section 31 to drive and rotate the control spring 20 for adjusting the tension thereof so as to form the tension adjuster 3. An engagement member 22 is fitted with a rear end of the control spring 20 securely disposed on the threaded section 35 of the fitting section 34. A cushion unit 23 is securely fitted on a rear end of the rotary rod 21. The engagement member 22 and the cushion unit 23 are engaged and connected with the inner circumference of the sleeve 5 and located therein (as shown in FIG. 4 as well as FIG. 1).

Figure 5:
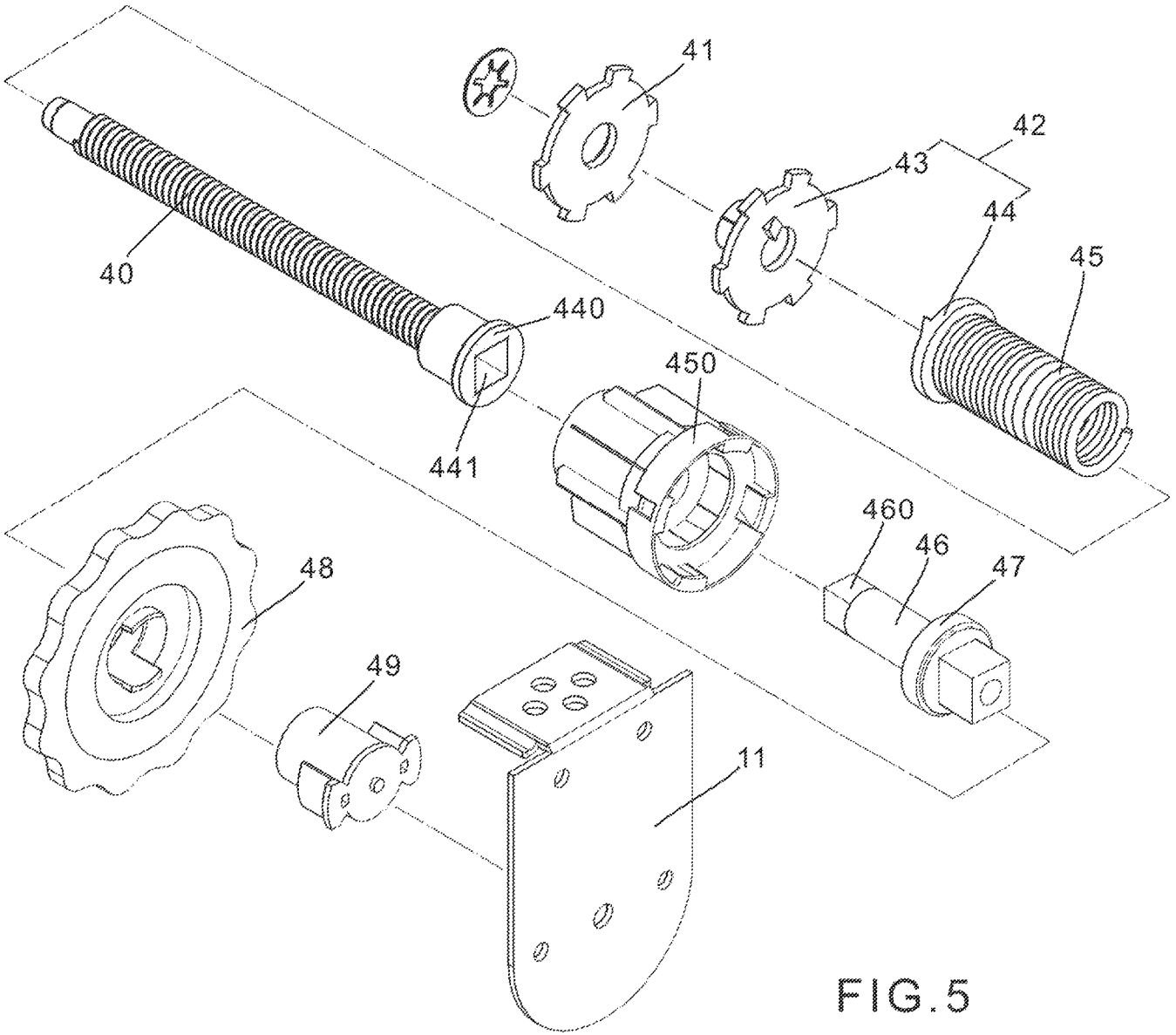
FIG. 5 is a perspective view showing the structure of the shutter sheet locating unit of the present invention.
Figure 6:
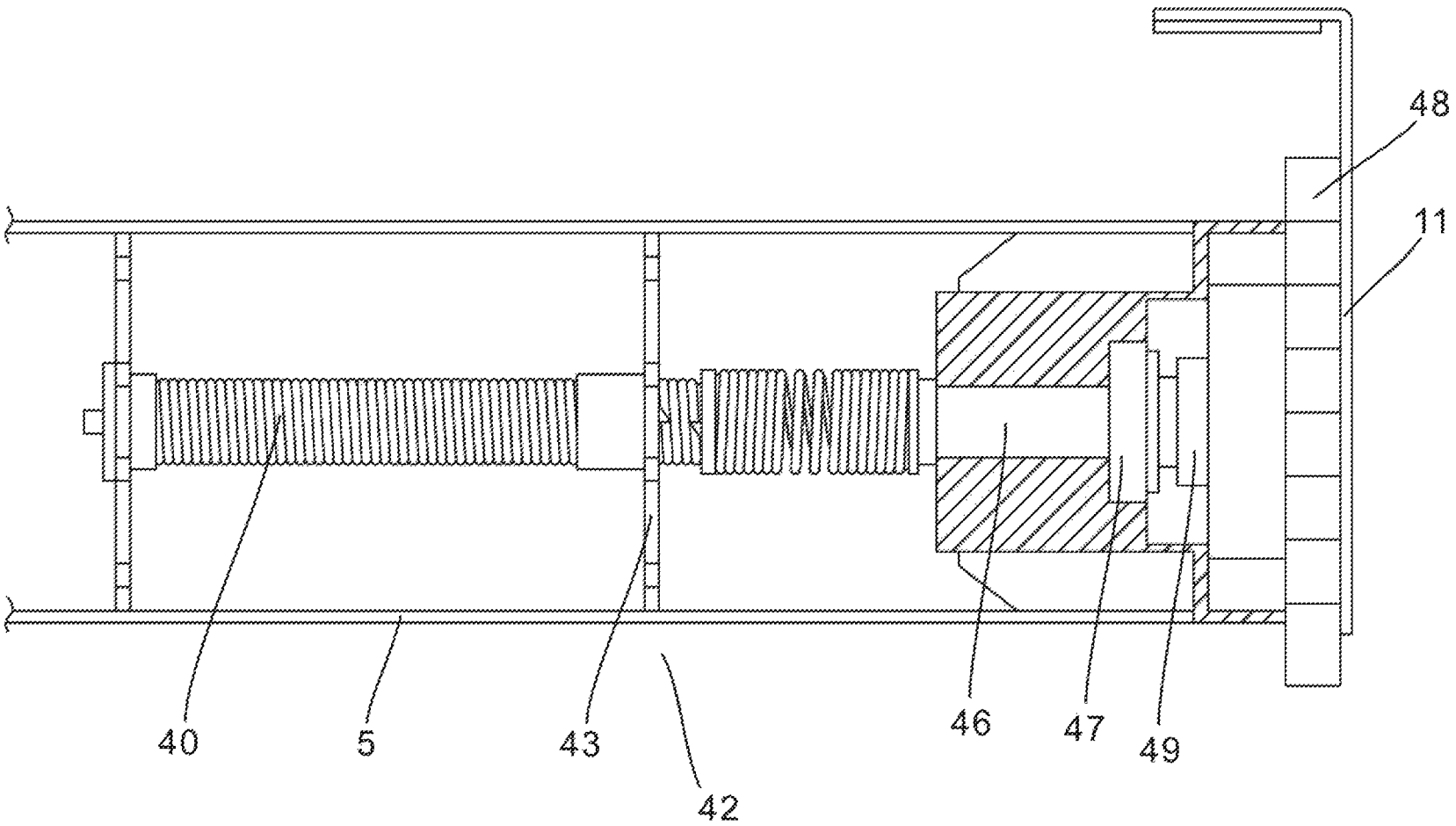
FIG. 6 is a sectional assembled view of the shutter sheet locating unit of the present invention.

Referring to FIGS. 5 and 6, the shutter sheet locating unit 4 includes an adjustment threaded rod 40, another engagement member 41 screwed on the adjustment threaded rod 40 and a locking member 42. The other engagement member 41 is engaged and connected with the inner circumference of the sleeve 5 and located therein. The locking member 42 has a movable plate 43 and a fixed plate 44. A cushioning spring 45 is fitted behind the fixed plate 44. The cushioning spring 45 is also fitted around the adjustment threaded rod 40 and connected with a connection seat 440. A front end of the connection seat 440 is securely connected with the adjustment threaded rod 40. A rear end face of the connection seat 440 is formed with a square hole 441, whereby the connection seat 440 is passed through another sleeve collar 450 to connect with a square bolt 460 of an assembling section 46. Another bearing 47 is fitted on the assembling section 46 to provide lubrication effect for the rotation of the other sleeve collar 450, whereby the another sleeve collar 450 can be more smoothly rotated and operated with less strength. The rear end of the assembling section 46 is further fitted with another shaft seat 49 of another adjustment disc 48. The other adjustment disc 48 is used to adjust the position of the movable plate 43 of the locking member 42 so as to lock the upward rolled shutter sheet at a height. The other adjustment disc 48 is connected with the other fixing bracket 11.

Figure 7:
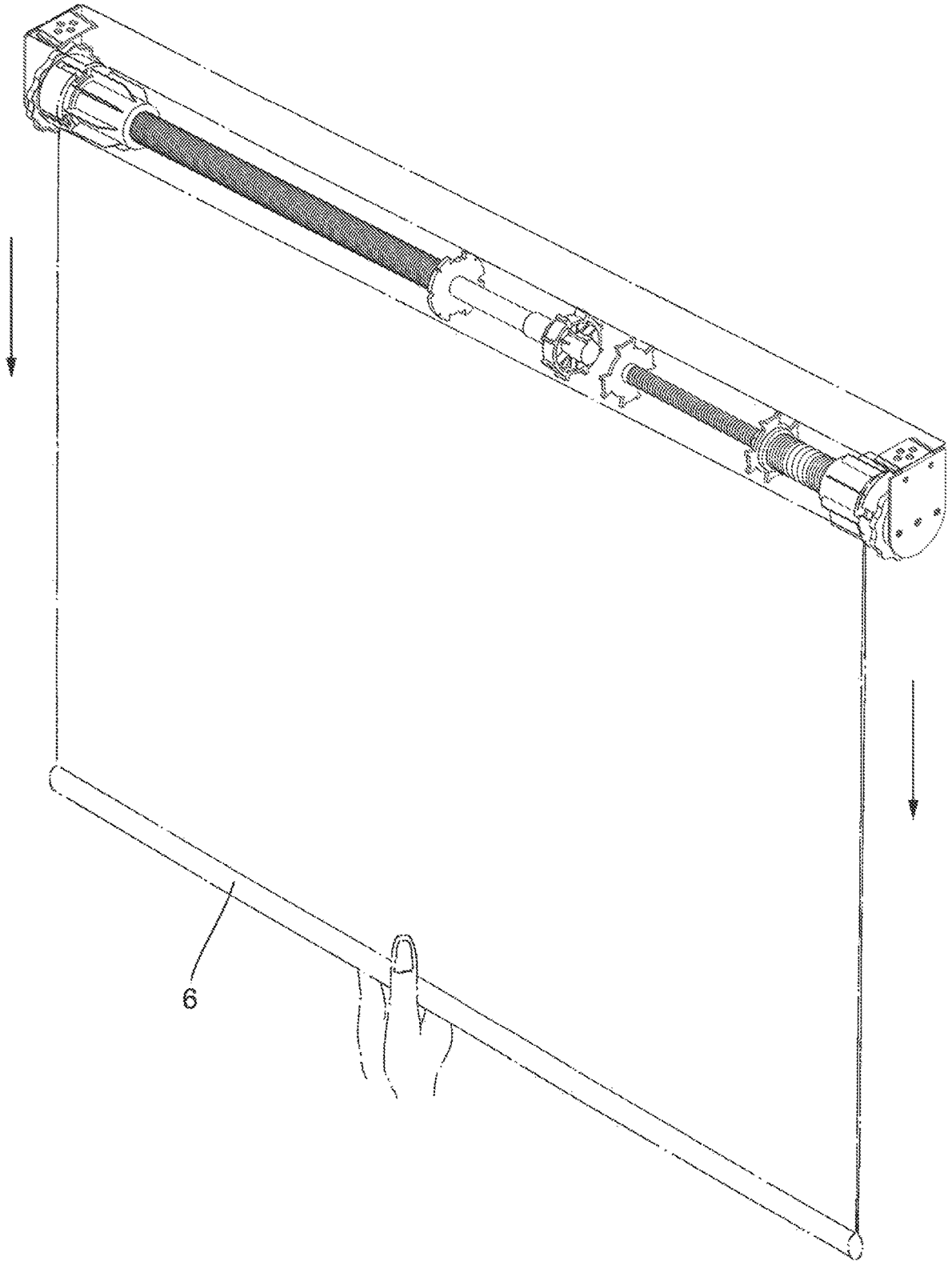
FIG. 7 is a perspective view showing that the shutter sheet of the present invention is pulled downward.
Figure 8:
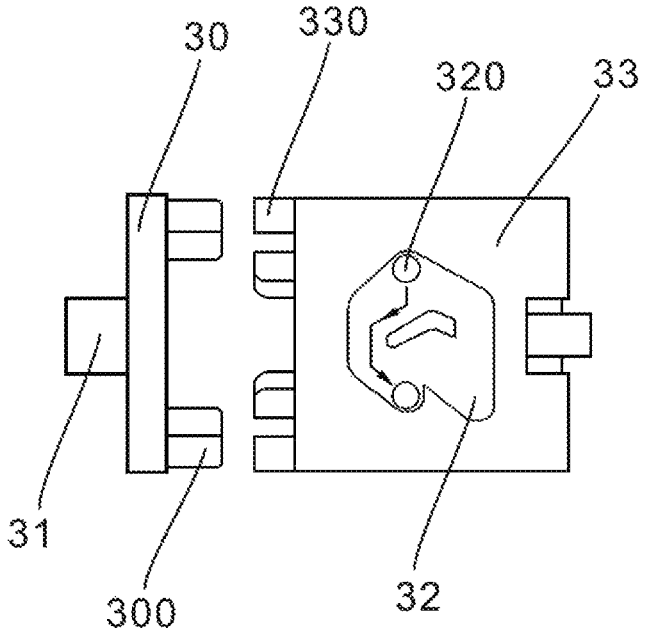
FIG. 8 is a view showing the operation of the rotor of the present invention.
Figure 9:
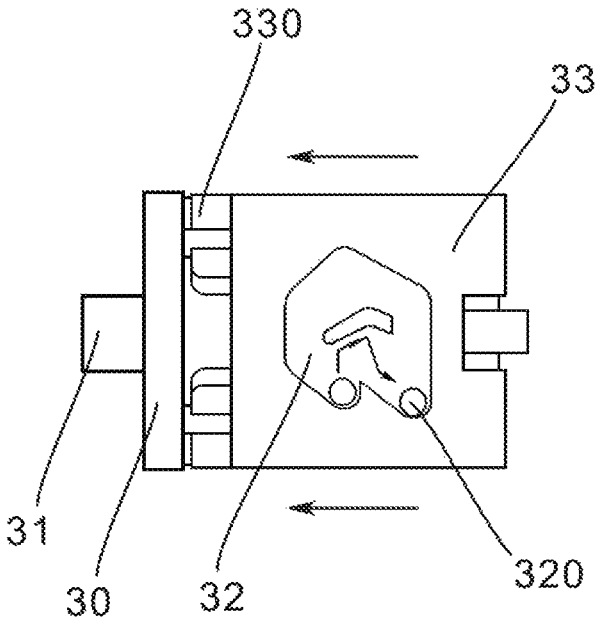
FIG. 9 is a view showing that the rotor of the present invention is engaged.
Figure 10:
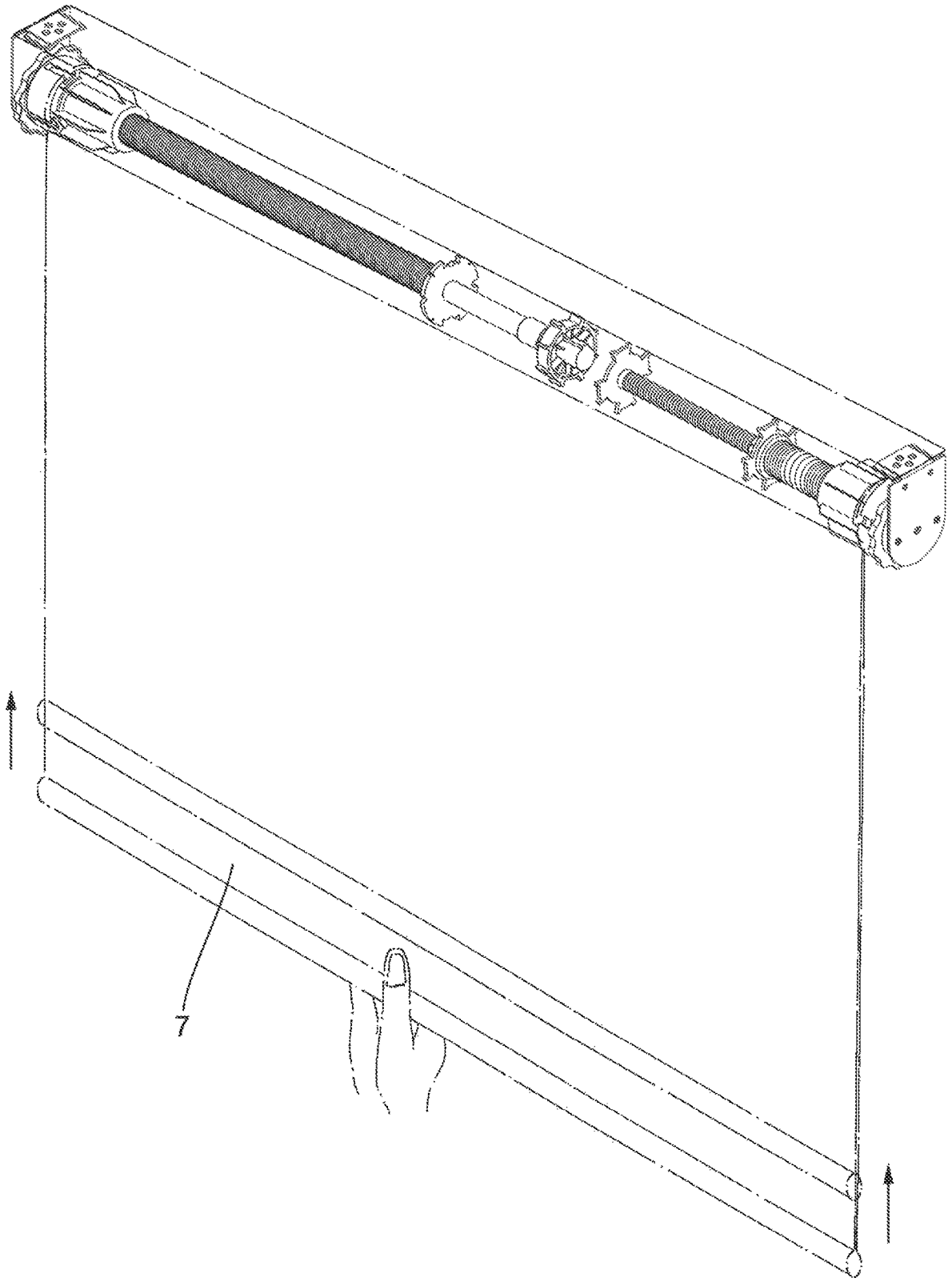
FIG. 10 is a view showing the operation of the shutter sheet of the present invention.
Figure 11:
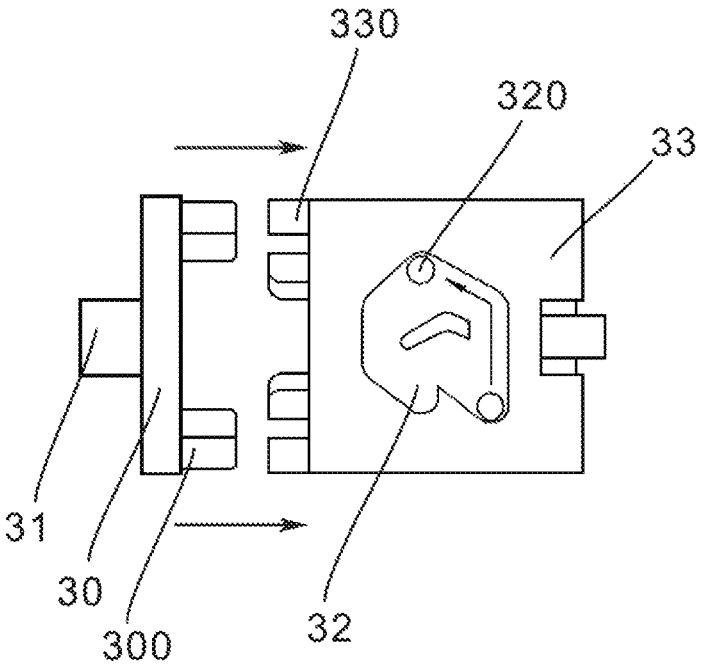
FIG. 11 is a view showing that the rotor of the present invention is disengaged.

Please now refer to FIG. 7. When using the roller shutter to shade sunlight, a user can directly hold the lower weight of the shutter sheet with one hand to pull the shutter sheet downward. At this time, the shutter sheet drives the sleeve collar 15 to rotate, whereby the shift pin 320 in the sleeve collar 15 slides within the shift recess 32 of the rotor 33 from a topmost point of the shift recess 32 to an opposite low point (as shown in FIG. 8). Accordingly, the rotor 33 is displaced to disengage from the plug section 31, permitting the shutter sheet to freely ascend or descend. When the shutter sheet stops moving, the shift pin 320 slides from the low point of the shift recess 32 to a right low point of the shift recess 32 (as shown in FIG. 9) to push the rotor 33 to displace forward and engage with the plug section 31, whereby the shutter sheet is stopped from moving. When it is desired not to shade the sunlight, the user only needs to pull the lower weight of the shutter sheet once again (as shown in FIG. 10), whereby the shift pin 320 in the sleeve collar 15 slides within the shift recess 32 of the rotor 33 from the right low point of the shift recess 32 to the topmost point of the shift recess 32 (as shown in FIG. 11). At this time, the rotor 33 is pushed to displace and disengage from the plug section, whereby the winding force of the spring drives the sleeve collar 15 to rotate so that the shutter sheet is rolled up.

Figure 12:
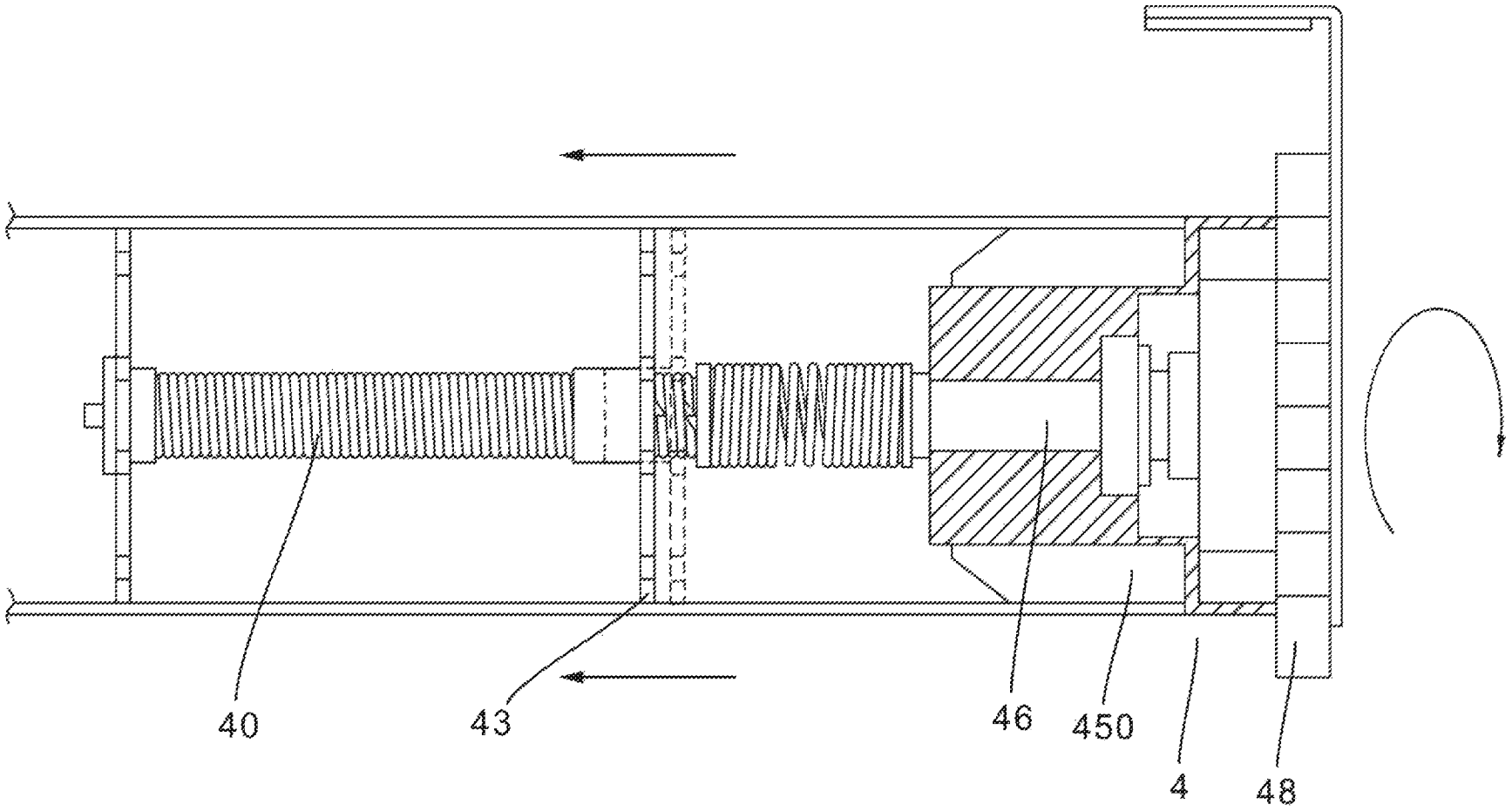
FIG. 12 is a view showing that the shutter sheet of the present invention is adjusted to a set position.
Figure 13:
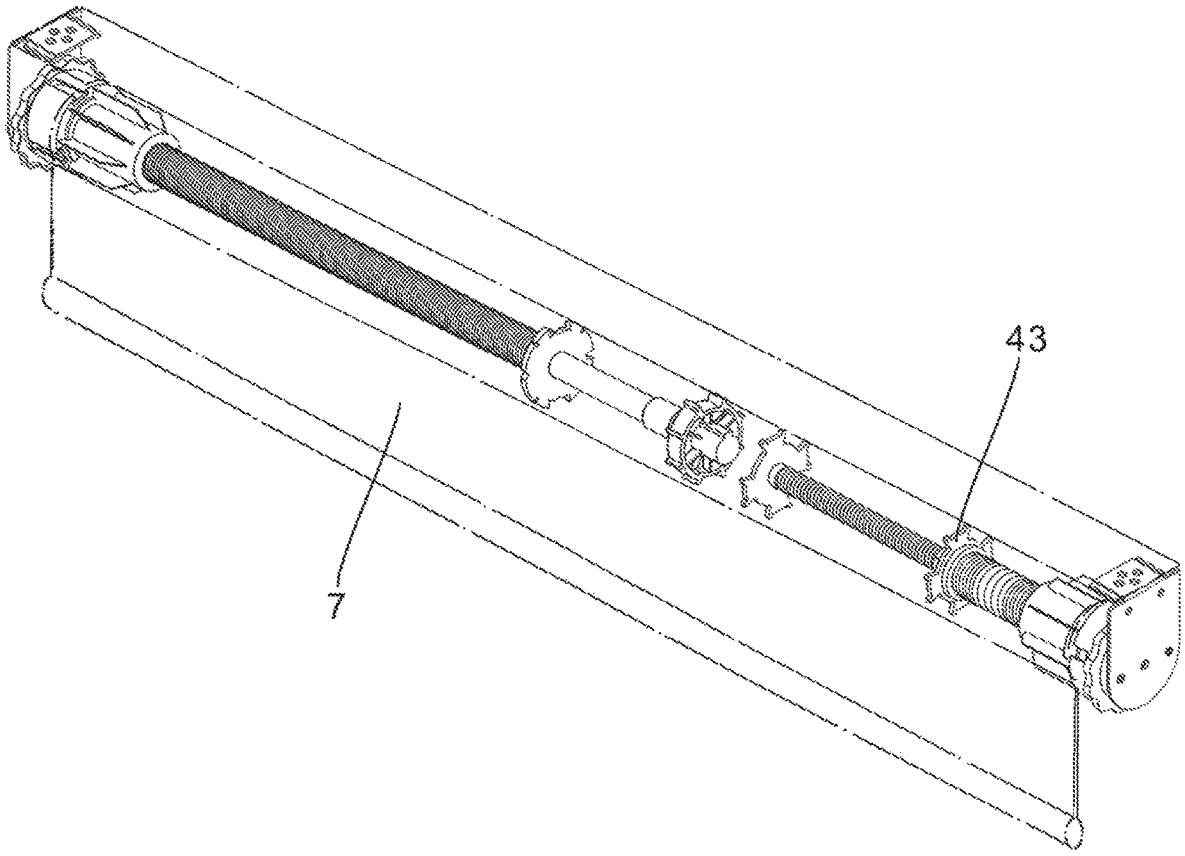
FIG. 13 is a view showing that the shutter sheet of the present invention is located in the set position.

As shown in FIGS. 12 and 13, when a user desires to roll and lock the shutter sheet in a specific position, the user rotates the adjustment disc 48 to drive and rotate the adjustment threaded rod 40 via the assembling section 46. At this time, the movable plate 43 of the locking member 42 is driven by the adjustment threaded rod 40 to move a set position and then the user stops rotating the adjustment disc 48. Accordingly, when the shutter sheet is pulled downward to make the movable plate 43 more forward and restore to the set position, the sleeve 5 is rotated by the shutter sheet and the movable plate 43 is driven to move rearward along the adjustment threaded rod 40 back to the originally adjusted and set position and stop. Under such circumstance, the shutter sheet is stopped in the set position.

Figure 14:
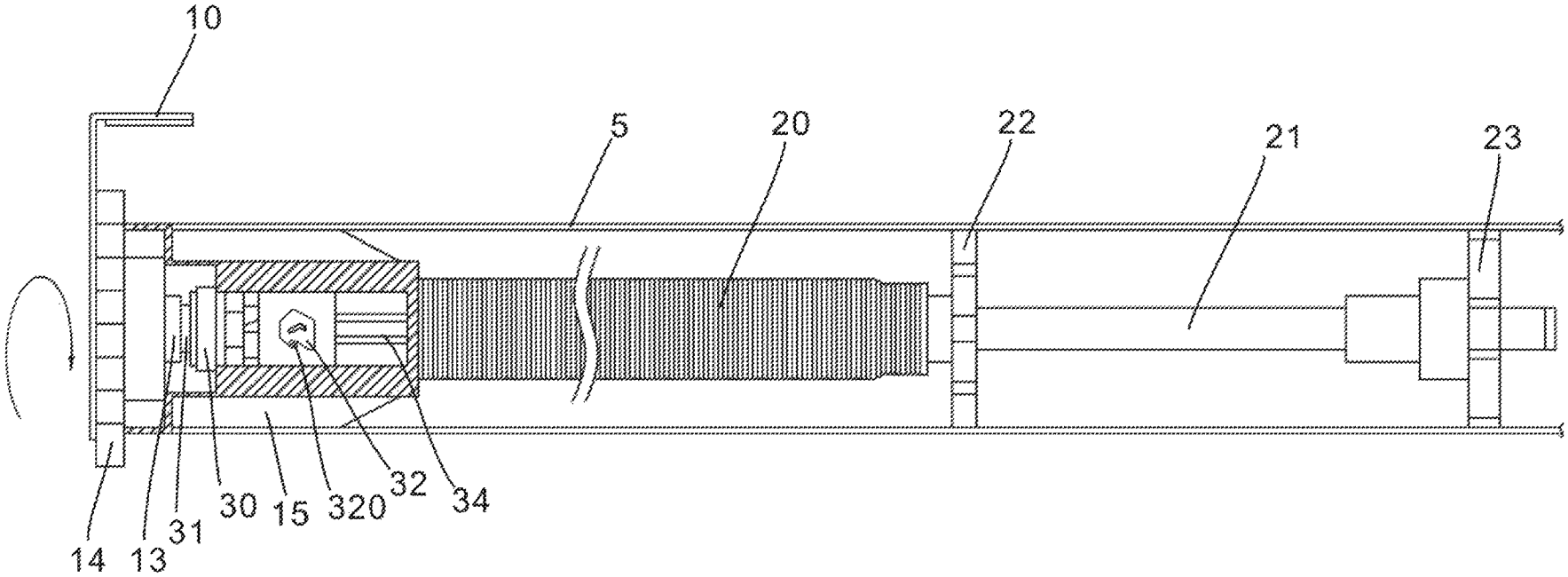
FIG. 14 is a view showing the adjustment of the spring of the present invention.

In case the user feels that the shutter sheet is rolled too slow or too fast (with reference to FIGS. 14 and 3), the adjustment disc 14 is rotated to drive the shaft seat 12, whereby the connection section 13 at the front drives the plug section 31 to rotate. The linking section 300 of the plug section 31 synchronously drives the fitting section 34 to adjust the tension of the control spring 20, whereby the shutter sheet can be driven by a tenser spring or a looser spring to roll more slowly or faster. Accordingly, the roller shutter can be safely used.

The above embodiments are only used to illustrate the present invention, not intended to limit the scope thereof. Many modifications of the above embodiments can be made without departing from the spirit of the present invention.

What is claimed is:

1. A cordless roller shutter structure comprising:

a roller shutter fixing seat having a fixing support frame, two fixing brackets being disposed on opposing ends of the fixing support frame, a tension adjuster having a first end securely disposed on an inner end face of a first fixing bracket of the two fixing brackets and a second end connected with a first end of a sleeve controller;

the sleeve controller fitted in a sleeve, the sleeve controller including a plug section fitted with a first bearing and a rotor formed with shift recesses and a fitting section, the rotor being connected with the plug section, a threaded section being disposed at one end of the fitting section, the threaded section being fitted with a rotary rod and a control spring fitted on the rotary rod, an engagement member being movably fitted with one end of the control spring, the engagement member being engaged and connected with an inner circumference of the sleeve and located therein, a cushion unit being disposed at one end of the rotary rod, the cushion unit being engaged and connected with the inner circumference of the sleeve and located therein;

the tension adjuster including an adjustment disc and a shaft seat, a connection section protruding from a front end of the shaft seat, the connection section serving to assemble and connect with the plug section of the sleeve controller and drive the fitting section to adjust the tension of the control spring of the sleeve controller; and another shaft seat being securely disposed on an inner side of a second fixing bracket of the two fixing brackets, an assembling section protruding from a front end of the other another shaft seat for assembling and connecting with a shutter sheet locating unit, the shutter sheet locating unit being disposed at a second end of the sleeve of the sleeve controller, the shutter sheet locating unit including an adjustment threaded rod, an engagement member screwed on the adjustment threaded rod and a locking member, the locking member including a movable plate and a fixed plate, the movable plate being screwed on the adjustment threaded rod, a cushioning spring being fitted on a rear end of the fixed plate, the cushioning spring being fitted around the adjustment threaded rod and connected with a connection seat disposed at a rear end of the adjustment threaded rod and fitted through a second sleeve collar to assemble and connect with the assembling section, a rear end of the assembling section being fitted with another adjustment disc for adjusting the position of the locking member so as to control and locate a shutter sheet, the assembling section connected to the shutter sheet locating unit having a second bearing, the first bearing of the plug section being inserted into a first sleeve collar of the sleeve controller, and the second bearing of the assembling section being inserted into the second sleeve collar of the shutter sheet locating unit for the rotation of the sleeve.

* * * * *